US011453839B2

(12) United States Patent
Shono et al.

(10) Patent No.: US 11,453,839 B2
(45) Date of Patent: Sep. 27, 2022

(54) REFRIGERATOR OIL

(71) Applicant: ENEOS Corporation, Tokyo (JP)

(72) Inventors: Yohei Shono, Tokyo (JP); Tatsuki Nakajima, Tokyo (JP); Shogo Hashimoto, Tokyo (JP); Hidetoshi Ogata, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 0 days.

(21) Appl. No.: 17/270,179

(22) PCT Filed: Aug. 27, 2019

(86) PCT No.: PCT/JP2019/033566
§ 371 (c)(1),
(2) Date: Feb. 22, 2021

(87) PCT Pub. No.: WO2020/045452
PCT Pub. Date: Mar. 5, 2020

(65) Prior Publication Data

US 2021/0324295 A1 Oct. 21, 2021

(30) Foreign Application Priority Data

Aug. 28, 2018 (JP) ..... JP2018-159417

(51) Int. Cl.

| | |
|---|---|
| ***C10M 171/00*** | (2006.01) |
| ***C10M 105/42*** | (2006.01) |
| ***C10M 129/18*** | (2006.01) |
| ***C10M 137/02*** | (2006.01) |
| ***C10N 20/00*** | (2006.01) |
| ***C10N 40/30*** | (2006.01) |

(52) U.S. Cl.
CPC ..... *C10M 171/008* (2013.01); *C10M 105/42* (2013.01); *C10M 129/18* (2013.01); *C10M 137/02* (2013.01); *C10M 2207/042* (2013.01); *C10M 2207/301* (2013.01); *C10M 2223/049* (2013.01); *C10N 2020/101* (2020.05); *C10N 2040/30* (2013.01)

(58) Field of Classification Search
CPC ..... C10M 105/42; C10M 129/18; C10M 137/02; C10M 171/008; C10M 2207/042; C10M 2207/301; C10M 2223/049; C10M 2020/101; C10M 2040/30
See application file for complete search history.

(56) References Cited

U.S. PATENT DOCUMENTS

| | | | |
|---|---|---|---|
| 5,326,486 | A | 7/1994 | Mizui et al. |
| 2012/0132848 | A1 | 5/2012 | Sawada et al. |
| 2012/0228541 | A1 | 9/2012 | Takigawa et al. |
| 2012/0322706 | A1 | 12/2012 | Matsumoto et al. |
| 2015/0048271 | A1 | 2/2015 | Kaneko et al. |
| 2015/0307761 | A1 | 10/2015 | Saito et al. |
| 2015/0344760 | A1 | 12/2015 | Saito et al. |
| 2016/0333241 | A1* | 11/2016 | Fukushima ..... C10M 171/00 |

FOREIGN PATENT DOCUMENTS

| | | |
|---|---|---|
| CN | 1072948 | 6/1993 |
| CN | 101868522 | 10/2010 |
| CN | 102482611 | 5/2012 |
| CN | 102533392 | 7/2012 |
| CN | 102712871 | 10/2012 |
| CN | 104169406 | 11/2014 |
| CN | 104903431 | 9/2015 |
| CN | 104946354 | 9/2015 |
| CN | 106029853 | 10/2016 |
| CN | 107001970 | 8/2017 |
| CN | 107109284 | 8/2017 |
| CN | 108350381 | 7/2018 |
| EP | 2 471 896 | 7/2012 |
| EP | 2 930 228 | 10/2015 |
| JP | 59-75995 | 4/1984 |
| JP | H05-339590 | 12/1993 |
| JP | 2008-266423 | 11/2008 |
| JP | 2012-131994 | 7/2012 |
| JP | 2013-189506 | 9/2013 |
| JP | 2018-016736 | 2/2018 |
| WO | 2011/024663 | 3/2011 |
| WO | 2011/086800 | 7/2011 |
| WO | 2014/087903 | 6/2014 |
| WO | 2017/086221 | 5/2017 |

OTHER PUBLICATIONS

ISR issued in WIPO Patent Application No. PCT/JP2019/033566, Nov. 5, 2019, English translation.
Written Opinion issued in WIPO Patent Application No. PCT/JP2019/033566, dated Nov. 5, 2019, English translation.
IPRP issued in WIPO Patent Application No. PCT/JP2019/033566, Mar. 2, 2021, English translation.
EESR issued in EP Patent Application No. 19853566.8, Aug. 12, 2021.
Zhang, "Modern Lubricant and Fuel Additives", China Petrochem. Press, Dec. 31, 1991, p. 194, partial translation.

* cited by examiner

*Primary Examiner* — James C Goloboy
(74) *Attorney, Agent, or Firm* — Greenblum & Bernstein P.L.C.

(57) ABSTRACT

The present invention provides a refrigerating machine oil containing a lubricating base oil, a dialkyl hydrogen phosphite having two alkyl groups having 1 to 12 carbon atoms in the molecule, and an epoxy compound.

6 Claims, No Drawings

REFRIGERATOR OIL

TECHNICAL FIELD

The present invention relates to a refrigerating machine oil.

BACKGROUND ART

Refrigerating machines such as refrigerators, car air-conditioners, room air-conditioners, and automatic vending machines have a compressor for circulating a refrigerant in a refrigeration cycle. Further, the compressor is charged with a refrigerating machine oil for lubricating a sliding member. Generally, the refrigerating machine oil contains a base oil and an additive that are blended according to desired properties.

As the additive, for example, an antiwear agent to be added for improving antiwear property of the refrigerating machine oil is known. As the antiwear agent, for example, a phosphorus-based additive is exemplified. Patent Literature 1 discloses a refrigerating machine oil containing a phosphorus-based additive composed of phosphoric acid triester and/or phosphorus acid triester.

CITATION LIST

Patent Literature

Patent Literature 1: Japanese Unexamined Patent Publication No. 2008-266423

SUMMARY OF INVENTION

Technical Problem

An object of the present invention is to provide a refrigerating machine oil excellent in antiwear property.

Solution to Problem

The present inventors have solved the above-described problem by using a combination of a specific dialkyl hydrogen phosphite and an epoxy compound. That is, the present invention provides a refrigerating machine oil containing a lubricating base oil, a dialkyl hydrogen phosphite having two alkyl groups having 1 to 12 carbon atoms in the molecule, and an epoxy compound.

Advantageous Effects of Invention

According to the present invention, it is possible to provide a refrigerating machine oil excellent in antiwear property.

DESCRIPTION OF EMBODIMENTS

A refrigerating machine oil according to the present embodiment contains a lubricating base oil, a dialkyl hydrogen phosphite, and an epoxy compound.

As the lubricating base oil, a hydrocarbon oil, an oxygen-containing oil, and the like can be used. Examples of the hydrocarbon oil include a mineral oil-based hydrocarbon oil and a synthetic hydrocarbon oil. Examples of the oxygen-containing oil include ester, ether, carbonate, ketone, silicone, and polysiloxane.

The mineral oil-based hydrocarbon oil can be obtained by refining lubricating oil fractions obtained by atmospheric pressure distillation and reduced pressure distillation of a crude oil such as a paraffinic crude oil or a naphthenic crude oil, by a method such as solvent deasphalting, solvent refining, hydrorefining, hydrocracking, solvent dewaxing, hydrodewaxing, clay treatment, sulfuric acid cleaning. One of these refining methods may be used independently or two or more of the same may be used in combination.

Examples of the synthetic hydrocarbon oil include alkylbenzene, alkylnaphthalene, poly α-olefin (PAO), polybutene, and an ethylene-α-olefin copolymer.

As the alkylbenzene, an alkylbenzene (A) and/or an alkylbenzene (B) described below can be used.

Alkylbenzene (A): Alkylbenzene having 1 to 4 alkyl groups having 1 to 19 carbon atoms in which the total number of carbon atoms of the alkyl groups is 9 to 19 (preferably, alkylbenzene having 1 to 4 alkyl groups having 1 to 15 carbon atoms in which the total number of carbon atoms of the alkyl groups is 9 to 15)

Alkylbenzene (B): Alkylbenzene having 1 to 4 alkyl groups having 1 to 40 carbon atoms in which the total number of carbon atoms of the alkyl groups is 20 to 40 (preferably, alkylbenzene having 1 to 4 alkyl groups having 1 to 30 carbon atoms in which the total number of carbon atoms of the alkyl groups is 20 to 30)

Specific examples of the alkyl group having 1 to 19 carbon atoms of the alkylbenzene (A) include a methyl group, an ethyl group, a propyl group (including all isomers, the same applies hereinafter), a butyl group, a pentyl group, a hexyl group, a heptyl group, an octyl group, a nonyl group, a decyl group, anundecyl group, a dodecyl group, a tridecyl group, a tetradecyl group, a pentadecyl group, a hexadecyl group, a heptadecyl group, an octadecyl group, a nonadecyl group, and an eicosyl group. These alkyl groups may be linear or branched, and from the viewpoints of stability, viscosity property, and the like, these alkyl groups are preferably branched. Particularly, from the viewpoint of availability, a branched alkyl group derived from an oligomer of an olefin such as propylene, butene, or isobutylene is more preferred.

The number of alkyl groups in the alkylbenzene (A) is 1 to 4, and from the viewpoints of stability and availability, the number of alkyl groups is preferably 1 or 2 (that is, monoalkylbenzene, dialkylbenzene, or a mixture thereof).

The alkylbenzene (A) may contain only an alkylbenzene having a single structure, and if the alkylbenzene (A) satisfies conditions of having 1 to 4 alkyl groups having 1 to 19 carbon atoms and having the total number of carbon atoms of the alkyl groups of 9 to 19, the alkylbenzene (A) may contain a mixture of alkylbenzenes each having different structures.

Specific examples of the alkyl group having 1 to 40 carbon atoms of the alkylbenzene (B) include a methyl group, an ethyl group, a propyl group (including all isomers, the same applies hereinafter), a butyl group, a pentyl group, a hexyl group, a heptyl group, an octyl group, a nonyl group, a decyl group, anundecyl group, a dodecyl group, a tridecyl group, a tetradecyl group, a pentadecyl group, a hexadecyl group, a heptadecyl group, an octadecyl group, a nonadecyl group, an icosyl group, a henicosyl group, a docosyl group, a tricosyl group, a tetracosyl group, a pentacosyl group, a hexacosyl group, a heptacosyl group, an octacosyl group, a nonacosyl group, a triacontyl group, a hentriacontyl group, a dotriacontyl group, a tritriacontyl group, a tetratriacontyl group, a pentatriacontyl group, a hexatriacontyl group, a heptatriacontyl group, an octatriacontyl group, a nonatriacontyl group, and a tetracontyl group. These alkyl groups may be linear or branched, and from the viewpoints of stability, viscosity property, and the like, these alkyl groups are preferably branched. Particularly, from the viewpoint of availability, a branched alkyl group derived from an oligomer of an olefin such as propylene, butene, or isobutylene is more preferred.

The number of alkyl groups in the alkylbenzene (B) is 1 to 4, and from the viewpoints of stability and availability, the number of alkyl groups is preferably 1 or 2 (that is, monoalkylbenzene, dialkylbenzene, or a mixture thereof).

The alkylbenzene (B) may contain only an alkylbenzene having a single structure, and if the alkylbenzene (B) satisfies conditions of having 1 to 4 alkyl groups having 1 to 40 carbon atoms and having the total number of carbon atoms of the alkyl groups of 20 to 40, the alkylbenzene (B) may contain a mixture of alkylbenzenes each having different structures.

The poly α-olefin (PAO) is, for example, a compound obtained by polymerizing molecules of linear olefin having 6 to 18 carbon atoms and having a double bond at only one of the ends, followed by hydrogenation. The poly α-olefin may be, for example, isoparaffin having a molecular weight distribution mainly composed of trimers or tetramers of α-decene having 10 carbon atoms or α-dodecene having 12 carbon atoms.

Examples of esters include an aromatic ester, a dibasic acid ester, a polyol ester, a complex ester, a carbonic ester, and mixtures thereof. The ester is preferably a polyol ester or a complex ester.

The polyol ester is an ester of a polyhydric alcohol and a fatty acid. As the fatty acid, a saturated fatty acid is preferably used. The number of carbon atoms of the fatty acid is preferably 4 to 20, more preferably 4 to 18, further preferably 4 to 9, and particularly preferably 5 to 9. The polyol ester may be a partial ester in which a part of hydroxyl groups of a polyhydric alcohol and remains as a hydroxyl group without being esterified, may be a complete ester in which all of hydroxyl groups are esterified, or may be a mixture of a partial ester and a complete ester. The hydroxyl value of the polyol ester is preferably 10 mg KOH/g or less, more preferably 5 mg KOH/g or less, and further preferably 3 mg KOH/g or less.

The ratio of a fatty acid having 4 to 20 carbon atoms of fatty acids constituting the polyol ester is preferably 20 to 100% by mole, more preferably 50 to 100% by mole, further preferably 70 to 100% by mole, and particularly preferably 90 to 100% by mole.

Specific examples of the fatty acid having 4 to 20 carbon atoms include butanoic acid, pentanoic acid, hexanoic acid, heptanoic acid, octanoic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, and icosanoic acid. These fatty acids may be linear or branched. More specifically, a fatty acid branched at α position and/or β position is preferred, 2-methylpropanoic acid, 2-methylbutanoic acid, 2-methylpentanoic acid, 2-methylhexanoic acid, 2-ethylpentanoic acid, 2-methylheptanoic acid, 2-ethylhexanoic acid, 3,5,5-trimethylhexanoic acid, 2-ethylhexadecanoic acid, or the like is more preferred, and of them, 2-ethylhexanoic acid and 3,5,5-trimethylhexanoic acid are further preferred.

The fatty acid may include a fatty acid other than the fatty acid having 4 to 20 carbon atoms. The fatty acid other than the fatty acid having 4 to 20 carbon atoms may be, for example, a fatty acid having 21 to 24 carbon atoms. Specific examples thereof include heneicosanoic acid, docosanoic acid, tricosanoic acid, and tetracosanoic acid. These fatty acids may be linear or branched.

As a polyhydric alcohol constituting the polyol ester, a polyhydric alcohol having 2 to 6 hydroxyl groups is preferably used. The number of carbon atoms of the polyhydric alcohol is preferably 4 to 12 and more preferably 5 to 10. Specifically, the polyhydric alcohol is preferably a hindered alcohol such as neopentyl glycol, trimethylolethane, trimethylolpropane, trimethylolbutane, di-(trimethylolpropane), tri-(trimethylolpropane), pentaerythritol, or dipentaerythritol. The polyhydric alcohol is more preferably pentaerythritol or a mixed ester of pentaerythritol and dipentaerythritol, since it is particularly excellent in compatibility with a refrigerant and hydrolytic stability.

The complex ester is, for example, an ester synthesized by the following (a) or (b) method:

(a) a method in which a molar ratio between a polyhydric alcohol and a polybasic acid is adjusted to synthesize an ester intermediate in which a part of a carboxyl group of the polybasic acid remains therein without being esterified, and then the remaining carboxyl group is esterified by a monohydric alcohol; and (b) a method in which a molar ratio between a polyhydric alcohol and a polybasic acid is adjusted to synthesize an ester intermediate in which a part of a hydroxyl group of the polyhydric alcohol remains therein without being esterified, and then the remaining hydroxyl group is esterified by a monovalent fatty acid.

A complex ester obtained by the method of (b) described above tends to be slightly inferior in stability to a complex ester obtained by the method of (a) described above since a relatively strong acid is produced if the former is hydrolyzed when used as a refrigerating machine oil. The complex ester in the present embodiment is preferably a complex ester with higher stability obtained by the method of (a) described above.

The complex ester is an ester synthesized from, preferably, at least one selected from polyhydric alcohols having 2 to 4 hydroxyl groups, at least one selected from polybasic acids having 6 to 12 carbon atoms, and at least one selected from monohydric alcohols having 4 to 18 carbon atoms and monovalent fatty acids having 2 to 12 carbon atoms.

Examples of the polyhydric alcohol having 2 to 4 hydroxyl groups include neopentyl glycol, trimethylolpropane, and pentaerythritol. As the polyhydric alcohol having 2 to 4 hydroxyl groups, from the viewpoint that a suitable viscosity is ensured when a complex ester is used as a base oil and satisfactory low-temperature property is obtained, neopentyl glycol and trimethylolpropane are preferred, and from the viewpoint that the viscosity can be widely adjusted, neopentyl glycol is more preferred.

From the viewpoint of excellent lubricity, the polyhydric alcohol constituting the complex ester preferably further contains a dihydric alcohol having 2 to 10 carbon atoms other than neopentyl glycol, in addition to the polyhydric alcohol having 2 to 4 hydroxyl groups. Examples of the dihydric alcohol having 2 to 10 carbon atoms other than neopentyl glycol include ethylene glycol, propanediol, butanediol, pentanediol, hexanediol, 2-methyl-1,3-propanediol, 3-methyl-1,5-pentanediol, and 2,2-diethyl-1,3-pentanediol. Of these, from the viewpoint of excellent properties of the lubricating base oil, butanediol is preferred. Examples of the butanediol include 1,2-butanediol, 1,3-butanediol, 1,4-butanediol, and 2,3-butanediol. Of these, from the viewpoint of obtaining satisfactory properties, 1,3-butanediol and 1,4-butanediol are more preferred. The amount of the dihydric alcohol having 2 to 10 carbon atoms other than neopentyl glycol is preferably 1.2 mol or less, more preferably 0.8 mol or less, and further preferably 0.4 mol or less with respect to 1 mol of the polyhydric alcohol having 2 to 4 hydroxyl groups.

Examples of the polybasic acid having 6 to 12 carbon atoms include adipic acid, pimelic acid, suberic acid, azelaic acid, sebacic acid, phthalic acid, and trimellitic acid. Of these, from the viewpoints of excellent balance between properties of the synthesized ester and availability, adipic acid and sebacic acid are preferred, and adipic acid is more preferred. The amount of the polybasic acid having 6 to 12 carbon atoms is preferably 0.4 mol to 4 mol, more preferably 0.5 mol to 3 mol, and further preferably 0.6 mol to 2.5 mol with respect to 1 mol of the polyhydric alcohol having 2 to 4 hydroxyl groups.

Examples of the monohydric alcohol having 4 to 18 carbon atoms include aliphatic alcohols such as butanol, pentanol, hexanol, heptanol, octanol, nonanol, decanol, dodecanol, and oleyl alcohol. These monohydric alcohols may be linear or branched. From the viewpoint of balance of properties, the monohydric alcohol having 4 to 18 carbon atoms is preferably a monohydric alcohol having 6 to 10 carbon atoms and more preferably a monohydric alcohol having 8 to 10 carbon atoms. Of these, from the viewpoint that the low-temperature property of the synthesized complex ester becomes satisfactory, 2-ethylhexanol and 3,5,5-trimethylhexanol are further preferred.

Examples of the monovalent fatty acid having 2 to 12 carbon atoms include ethanoic acid, propanoic acid, butanoic acid, pentanoic acid, hexanoic acid, heptanoic acid, octanoic acid, nonanoic acid, decanoic acid, and dodecanoic acid. These monovalent fatty acids may be linear or branched. The monovalent fatty acid having 2 to 12 carbon atoms is preferably a monovalent fatty acid having 8 to 10 carbon atoms, and of these, from the viewpoint of low-temperature property, 2-ethylhexanoic acid and 3,5,5-trimethylhexanoic acid are more preferred.

Examples of the ether include polyvinyl alcohol, polyalkylene glycol, polyphenylether, perfluoroether, and mixtures thereof. As the ether, polyvinyl ether or polyalkylene glycol is preferred and polyvinyl ether is more preferred.

The polyvinyl ether has a structural unit represented by the following Formula (1).

(1)

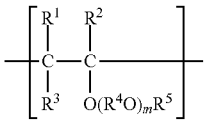

In Formula (1), $R^1$, $R^2$, and $R^3$ may be the same as or different from each other, and each represent a hydrogen atom or a hydrocarbon group, $R^4$ represents a divalent hydrocarbon group or a divalent ether bond oxygen-containing hydrocarbon group, $R^5$ represents a hydrocarbon group, and m represents an integer of 0 or more. In a case where m is 2 or more, a plurality of $R^4$ may be the same as or different from each other.

The number of carbon atoms of hydrocarbon groups represented by $R^1$, $R^2$, and $R^3$ is preferably 1 or more, more preferably 2 or more, and further preferably 3 or more, and is preferably 8 or less, more preferably 7 or less, and further preferably 6 or less. At least one of $R^1$, $R^2$, and $R^3$ is preferably a hydrogen atom, and all of $R^1$, $R^2$, and $R^3$ are more preferably hydrogen atoms.

The number of carbon atoms of the divalent hydrocarbon group and the ether bond oxygen-containing hydrocarbon group represented by $R^4$ is preferably 1 or more, more preferably 2 or more, and further preferably 3 or more, and is preferably 10 or less, more preferably 8 or less, and further preferably 6 or less. The divalent ether bond oxygen-containing hydrocarbon group represented by $R^4$ may be, for example, a hydrocarbon group having oxygen constituting an ether bond in the side chain thereof.

$R^5$ is preferably a hydrocarbon group having 1 to 20 carbon atoms. Examples of this hydrocarbon group include an alkyl group, a cycloalkyl group, a phenyl group, an aryl group, and an aryl alkyl group. Of these, an alkyl group is preferred, and an alkyl group having 1 to 5 carbon atoms is more preferred.

m is preferably 0 or more, more preferably 1 or more, and further preferably 2 or more, and is preferably 20 or less, more preferably 18 or less, and further preferably 16 or less. The average value of m of all structural units constituting the polyvinyl ether is preferably 0 to 10.

The polyvinyl ether may be a homopolymer composed of one structural unit selected from the structural units represented by Formula (1), a copolymer composed of two or more structural units selected from the structural units represented by Formula (1), and a copolymer composed of the structural units represented by Formula (1) and other structural units. When the polyvinyl ether is a copolymer, lubricity, insulation property, hygroscopicity, and the like can be further improved while satisfying the compatibility with a refrigerant in the refrigerating machine oil. At this time, by appropriately selecting the types of monomers to be used as raw materials, the types of initiators, the proportion of structural units in the copolymer, and the like, various properties of the refrigerating machine oil described above can be obtained as desired. The copolymer may be a block copolymer or a random copolymer.

In a case where the polyvinyl ether is a copolymer, the copolymer preferably has a structural unit (1-1) represented by the above Formula (1) in which $R^5$ is an alkyl group having 1 to 3 carbon atoms and a structural unit (1-2) represented by the above Formula (1) in which $R^5$ is an alkyl group having 3 to 20, preferably 3 to 10, and further preferably 3 to 8 carbon atoms. $R^5$ in the structural unit (1-1) is particularly preferably an ethyl group, and $R^5$ in the structural unit (1-2) is particularly preferably an isobutyl group. In a case where the polyvinyl ether is a copolymer having the above structural units (1-1) and (1-2), the molar ratio of the structural unit (1-1) to the structural unit (1-2) is preferably 5:95 to 95:5, more preferably 20:80 to 90:10, and further preferably 70:30 to 90:10. When the molar ratio is within the above-described range, there are tendencies that the compatibility with a refrigerant can be more improved, and hygroscopicity can be decreased.

The polyvinyl ether may be composed of only structural units represented by the above Formula (1) and may be a copolymer further having structural units represented by the following Formula (2). In this case, the copolymer may be a block copolymer or a random copolymer.

(2)

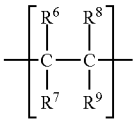

In Formula (2), $R^6$ to $R^9$ may be the same as or different from each other, and each represent a hydrogen atom or a hydrocarbon group having 1 to 20 carbon atoms.

The polyvinyl ether can be produced by polymerization of vinyl ether-based monomers corresponding to structural units represented by Formula (1), or by copolymerization of vinyl ether-based monomers corresponding to structural units represented by Formula (1) and hydrocarbon monomers having olefinic double bonds corresponding to structural units represented by Formula (2). As the vinyl ether-based monomers corresponding to structural units represented by Formula (1), monomers represented by the following Formula (3) are suitable.

(3)

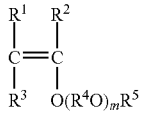

In the formula, $R^1$, $R^2$, $R^3$, $R^4$, $R^5$, and m each represent the same as defined for $R^1$, $R^2$, $R^3$, $R^4$, $R^5$, and min Formula (1).

The polyvinyl ether has preferably the following terminal structure (A) or (B).

In the structure (A), one end is represented by Formula (4) or (5), and the other end is represented by Formula (6) or (7).

(4)

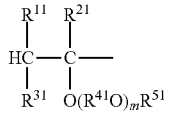

In Formula (4), $R^{11}$, $R^{21}$, and $R^3$ may be the same as or different from each other, and each represent a hydrogen atom or a hydrocarbon group having 1 to 8 carbon atoms, $R^{41}$ represents a divalent hydrocarbon group or divalent ether bond oxygen-containing hydrocarbon group having 1 to 10 carbon atoms, $R^{51}$ represents a hydrocarbon group having 1 to 20 carbon atoms, and m represents the same as defined for m in Formula (1). In a case where m is 2 or more, a plurality of $R^{41}$ may be the same as or different from each other.

(5)

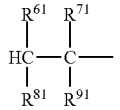

In Formula (5), $R^{61}$, $R^{71}$, $R^{81}$, and $R^{91}$ may be the same as or different from each other, and each represent a hydrogen atom or a hydrocarbon group having 1 to 20 carbon atoms.

(6)

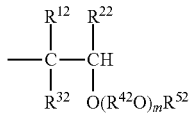

In Formula (6), $R^{12}$, $R^{22}$, and $R^{32}$ may be the same as or different from each other, and each represent a hydrogen atom or a hydrocarbon group having 1 to 8 carbon atoms, $R^{42}$ represents a divalent hydrocarbon group or divalent ether bond oxygen-containing hydrocarbon group having 1 to 10 carbon atoms, $R^{52}$ represents a hydrocarbon group having 1 to 20 carbon atoms, and m represents the same as defined for m in Formula (1). In a case where m is 2 or more, a plurality of $R^{41}$ may be the same or different.

(7)

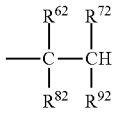

In Formula (7), $R^{62}$, $R^{72}$, $R^{82}$, and $R^{92}$ may be the same as or different from each other, and each represent a hydrogen atom or a hydrocarbon group having 1 to 20 carbon atoms.

In the structure (B), one end is represented by the above Formula (4) or (5), and the other end is represented by the following Formula (8).

(8)

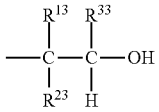

In Formula (8), $R^{13}$, $R^{23}$, and $R^{33}$ may be the same as or different from each other, and each represent a hydrogen atom or a hydrocarbon group having 1 to 8 carbon atoms.

Of such polyvinyl ethers, the following polyvinyl ethers (a), (b), (c), (d) and (e) are particularly suitable as base oils:

(a) a polyvinyl ether having a structure in which one end is represented by Formula (4) or (5), and the other end is represented by Formula (6) or (7), wherein in Formula (1), $R^1$, $R^2$, and $R^3$ are all hydrogen atoms, m is an integer of 0 to 4, $R^4$ is a divalent hydrocarbon group having 2 to 4 carbon atoms, and $R^5$ is a hydrocarbon group having 1 to 20 carbon atoms;

(b) a polyvinyl ether having only structural units represented by Formula (1) and a structure in which one end is represented by Formula (4), and the other end is represented by Formula (6), wherein in Formula (1), $R^1$, $R^2$, and $R^3$ are all hydrogen atoms, m is an integer of 0 to 4, $R^4$ is a divalent hydrocarbon group having 2 to 4 carbon atoms, and $R^5$ is a hydrocarbon group having 1 to 20 carbon atoms;

(c) a polyvinyl ether having a structure in which one end is represented by Formula (4) or (5), and the other end is represented by Formula (8), wherein in Formula (1), $R^1$, $R^2$, and $R^3$ are all hydrogen atoms, m is an integer of 0 to 4, $R^4$ is a divalent hydrocarbon group having 2 to 4 carbon atoms, and $R^5$ is a hydrocarbon group having 1 to 20 carbon atoms;

(d) a polyvinyl ether having only structural units represented by Formula (1) and a structure in which one end is represented by Formula (5), and the other end is represented by Formula (8), wherein in Formula (1), $R^1$, $R^2$, and $R^3$ are all hydrogen atoms, m is an integer of 0 to 4, $R^4$ is a divalent hydrocarbon group having 2 to 4 carbon atoms, and $R^5$ is a hydrocarbon group having 1 to 20 carbon atoms; and (e) any one of the above polyvinyl ethers (a), (b), (c) and (d) having a structural unit in which $R^5$ is a hydrocarbon group having 1 to 3 carbon atoms in Formula (1) and a structural unit in which the $R^5$ is a hydrocarbon group having 3 to 20 carbon atoms.

The degree of unsaturation of the polyvinyl ether is preferably 0.04 meq/g or less, more preferably 0.03 meq/g or less, and further preferably 0.02 meq/g or less. The peroxide value of the polyvinyl ether is preferably 10.0 meq/kg or less, more preferably 5.0 meq/kg or less, and further preferably 1.0 meq/kg. The carbonyl value of the polyvinyl ether is preferably 100 ppm by weight or less, more preferably 50 ppm by weight or less, and further preferably 20 ppm by weight or less. The hydroxyl value of the polyvinyl ether is preferably 10 mg KOH/g or less, more preferably 5 mg KOH/g or less, and further preferably 3 mg KOH/g or less.

The degree of unsaturation, the peroxide value, and the carbonyl value in the present invention respectively refer to values measured according to the standard methods for the analysis of fats, oils and related materials established by the Japan Oil Chemists' Society. That is, the degree of unsaturation in the present invention refers to a value (meq/g) obtained by reacting a sample with a Wijs solution (ICl-acetic acid solution), leaving the reaction mixture to stand in a dark place, subsequently reducing the excess ICl to iodine, titrating the iodine portion with sodium thiosulfate to calculate the iodine value, and then converting the iodine value to vinyl equivalents. The peroxide value in the present invention refers to a value (meq/kg) obtained by adding potassium iodide to a sample, titrating the produced free iodine with sodium thiosulfate, and converting the free iodine to milliequivalents with respect to 1 kg of the sample. The carbonyl value in the present invention refers to a value (ppm by weight) obtained by allowing 2,4-dinitrophenylhydrazine to act on a sample to produce chromogenic quinoid ions, measuring the absorbance of this sample at 480 nm, and converting it to a carbonyl content based on a predetermined calibration curve found with cinnamaldehyde as the standard substance. The hydroxyl value in the present invention means a hydroxyl value measured according to JIS K0070:1992.

Examples of the polyalkylene glycol include polyethylene glycol, polypropylene glycol, and polybutylene glycol. The polyalkylene glycol has oxyethylene, oxypropylene, oxybutylene, and the like as structural units. The polyalkylene glycol having these structural units can be obtained by ring-opening polymerization of monomers including ethylene oxide, propylene oxide, and butylene oxide as raw materials.

Examples of the polyalkylene glycol include compounds represented by the following Formula (9).

$$R^{\alpha}—[(OR^{\beta})_f—OR^{\gamma}]_g \quad (9)$$

In Formula (9), $R^{\alpha}$ represents a hydrogen atom, an alkyl group having 1 to 10 carbon atoms, an acyl group having 2 to 10 carbon atoms, or a residue of a compound having 2 to 8 hydroxyl groups, $R^{\beta}$ represents an alkylene group having 2 to 4 carbon atoms, $R^{\gamma}$ represents a hydrogen atom, an alkyl group having 1 to 10 carbon atoms, or an acyl group having 2 to 10 carbon atoms, f represents an integer of 1 to 80, and g represents an integer of 1 to 8.

Alkyl groups represented by $R^{\alpha}$ and $R^{\gamma}$ may be linear, branched, or cyclic. The number of carbon atoms of the alkyl group is preferably 1 to 10 and more preferably 1 to 6. When the number of carbon atoms of the alkyl group is more than 10, the compatibility with a refrigerant tends to be lowered.

The alkyl group portions of the acyl groups represented by $R^{\alpha}$ and $R^{\gamma}$ may be linear, branched, or cyclic. The number of carbon atoms of the acyl group is preferably 2 to 10 and more preferably 2 to 6. When the number of carbon atoms of the acyl group is more than 10, the compatibility with a refrigerant may be lowered to cause phase separation.

In a case where groups represented by $R^{\alpha}$ and $R^{\gamma}$ are both alkyl groups or are both acyl groups, groups represented by $R^{\alpha}$ and $R^{\gamma}$ may be the same or different. In a case where g is 2 or more, a plurality of groups represented by $R^{\alpha}$ and $R^{\gamma}$ in the same molecule may be the same or different.

In a case where a group represented by $R^{\alpha}$ is a residue of a compound having 2 to 8 hydroxyl groups, the compound may be linear or cyclic.

From the viewpoint of excellent compatibility, at least one of $R^{\alpha}$ and $R^{\gamma}$ is preferably an alkyl group, more preferably an alkyl group having 1 to 4 carbon atoms, and further preferably a methyl group. From the viewpoint of excellent thermal and chemical stability, both of $R^{\alpha}$ and $R^{\gamma}$ are preferably an alkyl group, more preferably an alkyl group having 1 to 4 carbon atoms, and further preferably a methyl group. From the viewpoints of ease of production and cost, it is preferable that any one of $R^{\alpha}$ and $R^{\gamma}$ is an alkyl group (more preferably, an alkyl group having 1 to 4 carbon atoms) and the other of them is a hydrogen atom, and it is more preferable that one of them is a methyl group and the other thereof is a hydrogen atom. From the viewpoints of lubricity and sludge solubility, both of $R^{\alpha}$ and $R^{\gamma}$ are preferably hydrogen atoms.

$R^{\beta}$ represents an alkylene group having 2 to 4 carbon atoms, and specific examples of such an alkylene group include an ethylene group, a propylene group, and a butylene group. Furthermore, examples of an oxyalkylene group of the repeating unit represented by $OR^{\beta}$ include an oxyethylene group, an oxypropylene group, and an oxybutylene group. An oxyalkylene group represented by $(OR^{\beta})_f$ may be composed of one oxyalkylene group and may be composed of two or more oxyalkylene groups.

Among the polyalkylene glycols represented by Formula (9), from the viewpoints of excellent compatibility with a refrigerant and viscosity-temperature properties, a copolymer including an oxyethylene group (EO) and an oxypropylene group (PO) is preferred. In this case, from the viewpoints of excellent seizure load and viscosity-temperature properties, the ratio (EO/(PO+EO)) of the oxyethylene group based on the total of the oxyethylene group and the oxypropylene group is preferably 0.1 to 0.8 and more preferably 0.3 to 0.6. From the viewpoints of excellent hygroscopicity and thermal and oxidative stability, EO/(PO+EO) is preferably 0 to 0.5, more preferably 0 to 0.2, and most preferably 0 (that is, a propylene oxide homopolymer).

f represents a repetition number (degree of polymerization) of an oxyalkylene group $OR^{\beta}$, and is an integer of 1 to 80. g is an integer of 1 to 8. For example, in a case where $R^{\alpha}$ is an alkyl group or an acyl group, g is 1. In a case where $R^{\alpha}$ is a residue of a compound having 2 to 8 hydroxyl groups, g is equal to the number of hydroxyl groups of the compound.

In the polyalkylene glycol represented by Formula (9), the average value of the product of f and g (f×g) is preferably 6 to 80 from the viewpoint of well-balanced satisfaction of required performances as the refrigerating machine oil.

The number average molecular weight of the polyalkylene glycol represented by Formula (9) is preferably 500 or more and more preferably 600 or more, and is preferably 3000 or less, more preferably 2000 or less, and further preferably 1500 or less. It is preferable that f and g are numbers that allow the number average molecular weight of the polyalkylene glycol to satisfy the above-described conditions. In a case where the number average molecular weight of the polyalkylene glycol is too small, lubricity in the coexistence of a refrigerant is insufficient in some cases. In a case where the number average molecular weight is too large, the composition range in which compatibility with a refrigerant is exhibited under a low temperature condition is narrowed so that poor lubrication in a refrigerant compressor or impediment of heat exchange in an evaporator is likely to occur.

The hydroxyl value of the polyalkylene glycol is preferably 100 mg KOH/g or less, more preferably 50 mg KOH/g or less, further preferably 30 mg KOH/g or less, and most preferably 10 mg KOH/g or less.

The polyalkylene glycol can be synthesized using a known method ("Alkylene oxide polymer", Shibata Mitsuta et al., KAIBUNDO, published on Nov. 20, 1990). For example, one or more predetermined alkylene oxides are addition-polymerized to an alcohol ($R^{\alpha}OH$; $R^{\alpha}$ is as defined for $R^{\alpha}$ in Formula (9)), and further a terminal hydroxyl group is etherified or esterified to obtain a polyalkylene glycol represented by Formula (9). In a case where two or more alkylene oxides are used in the production process described above, a polyalkylene glycol to be obtained may be a random copolymer or a block copolymer; however, from the viewpoint of tending to be more excellent in oxidative stability and lubricity, a block copolymer is preferred, and from the viewpoint of tending to be more excellent in low temperature flowability, a random copolymer is preferred.

The degree of unsaturation of the polyalkylene glycol is preferably 0.04 meq/g or less, more preferably 0.03 meq/g or less, and most preferably 0.02 meq/g or less. The peroxide value is preferably 10.0 meq/kg or less, more preferably 5.0 meq/kg or less, and most preferably 1.0 meq/kg. The carbonyl value is preferably 100 ppm by weight or less, more preferably 50 ppm by weight or less, and most preferably 20 ppm by weight or less.

The kinematic viscosity at 40° C. of the lubricating base oil may be preferably 3 $mm^2/s$ or more, more preferably 4 $mm^2/s$ or more, and further preferably 5 $mm^2/s$ or more. The kinematic viscosity at 40° C. of the lubricating base oil may be preferably 1000 $mm^2/s$ or less, more preferably 500 $mm^2/s$ or less, and further preferably 400 $mm^2/s$ or less. The kinematic viscosity at 100° C. of the lubricating base oil may be preferably 1 $mm^2/s$ or more and more preferably 2 $mm^2/s$ or more. The kinematic viscosity at 100° C. of the lubricating base oil may be preferably 100 $mm^2/s$ or less and more preferably 50 $mm^2/s$ or less. The kinematic viscosity in the present invention means a kinematic viscosity measured according to JIS K2283:2000.

The content of the lubricating base oil may be 50% by mass or more, 60% by mass or more, 70% by mass or more, 80% by mass or more, or 90% by mass or more based on the total amount of the refrigerating machine oil.

The refrigerating machine oil according to the present embodiment contains a dialkyl hydrogen phosphite having two alkyl groups having 1 to 12 carbon atoms in the molecule (hereinafter, referred to as the "dialkyl hydrogen phosphite in the present embodiment").

The dialkyl hydrogen phosphite in the present embodiment may be, for example, at least one of a compound represented by the following Formula (b-1) and a compound represented by the following Formula (b-2) that is a tautomer thereof.

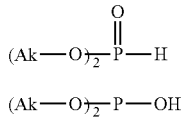

(b-1)

(b-2)

In Formulas (b-1) and (b-2), Ak represents an alkyl group having 1 to 12 carbon atoms.

Alkyl groups represented by Ak may be linear, branched, or cyclic. The number of carbon atoms of the alkyl group is preferably 4 to 12 and more preferably 8 to 12. When the number of carbon atoms of the alkyl group is 12 or less, the antiwear property of the refrigerating machine oil can be satisfactorily maintained. Furthermore, groups represented by a plurality of Ak in the same molecule are the same or different, and from the viewpoint of ease of synthesis, the groups are preferably the same as each other.

The content of the dialkyl hydrogen phosphite (including a tautomer thereof; the same applies hereinafter) in the present embodiment is preferably 0.005% by mass or more, more preferably 0.01% by mass or more, and further preferably 0.05% by mass or more, and is preferably 1% by mass or less, more preferably 0.8% by mass or less, further preferably 0.5% by mass or less, particularly preferably 0.3% by mass or less, and extremely preferably 0.1% by mass or less based on the total amount of the refrigerating machine oil. The content of the dialkyl hydrogen phosphite is preferably 0.005 to 1% by mass, more preferably 0.01 to 0.8% by mass, and further preferably 0.05 to 0.5% by mass based on the total amount of the refrigerating machine oil.

In the dialkyl hydrogen phosphite in the present embodiment, as long as it has two alkyl groups having 1 to 12 carbon atoms in the molecule, two or more dialkyl hydrogen phosphites may be used in combination. Furthermore, as long as the dialkyl hydrogen phosphite is contained in the refrigerating machine oil of the present embodiment, the purity thereof is not particularly limited, and it is desirable to use a pure product; however, depending on reasons of production processes, refining cost, and the like, a pure product may not be necessarily used. The purity of the dialkyl hydrogen phosphite to be blended in the refrigerating machine oil of the present embodiment is preferably 50% by mole or more and more preferably 70% by mole or more. The dialkyl hydrogen phosphite may be used as an additive containing the dialkyl hydrogen phosphite as a main component.

The refrigerating machine oil according to the present embodiment contains an epoxy compound. In a case where the refrigerating machine oil contains a dialkyl hydrogen phosphite having two alkyl groups having 1 to 12 carbon atoms in the molecule and an epoxy compound, high antiwear property can be obtained, for example, as compared with a case where the refrigerating machine oil contains another phosphorus-based antiwear agent (another hydrogen phosphite, phosphoric acid triester, phosphorus acid triester, or the like) and an epoxy compound.

Examples of the epoxy compound include a glycidyl ether-type epoxy compound, a glycidyl ester-type epoxy compound, an oxirane compound, an alkyloxirane compound, an alicyclic epoxy compound, an epoxidized fatty acid monoester, and an epoxidized vegetable oil. These epoxy compounds can be used singly or in combination of two or more kinds thereof.

As the glycidyl ether-type epoxy compound, for example, an aryl glycidyl ether-type epoxy compound or an alkyl glycidyl ether-type epoxy compound represented by the following Formula (C-1) can be used.

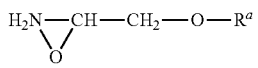

(C-1)

In Formula (C-1), $R^a$ represents an aryl group or an alkyl group having 5 to 18 carbon atoms.

As the glycidyl ether-type epoxy compound represented by Formula (C-1), n-butylphenyl glycidyl ether, i-butylphenyl glycidyl ether, sec-butylphenyl glycidyl ether, tert-butylphenyl glycidyl ether, pentylphenyl glycidyl ether, hexylphenyl glycidyl ether, heptylphenyl glycidyl ether, octylphenyl glycidyl ether, nonylphenyl glycidyl ether, decylphenyl glycidyl ether, decyl glycidyl ether, undecyl glycidyl ether, dodecyl glycidyl ether, tridecyl glycidyl ether, tetradecyl glycidyl ether, and 2-ethylhexyl glycidyl ether are preferred.

When the number of carbon atoms of the alkyl group represented by $R^a$ is 5 or more, the stability of the epoxy compound is ensured, and decomposition prior to reaction with water, a fatty acid, or an oxidatively degraded product, or self-polymerization in which the epoxy compounds polymerize with each other can be suppressed so that the desired functions are easily obtained. On the other hand, when the number of carbon atoms of the alkyl group represented by $R^a$ is 18 or less, the solubility with a refrigerant is satisfactorily ensured so that it is possible that defects such as poor cooling due to deposition in a refrigerating machine hardly occur.

As the glycidyl ether-type epoxy compound, other than the epoxy compound represented by Formula (C-1), neopentyl glycol diglycidyl ether, trimethylolpropane triglycidyl ether, pentaerythritol tetraglycidyl ether, 1,6-hexanediol diglycidyl ether, sorbitol polyglycidyl ether, polyalkylene glycol monoglycidyl ether, polyalkylene glycol diglycidyl ether, and the like can also be used.

As the glycidyl ester-type epoxy compound, for example, a compound represented by the following Formula (C-2) can be used.

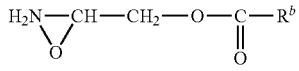

(C-2)

In Formula (C-2), $R^b$ represents an aryl group, an alkyl group having 5 to 18 carbon atoms, or an alkenyl group.

As the glycidyl ester-type epoxy compound represented by Formula (C-2), glycidyl benzoate, glycidyl neodecanoate, glycidyl-2,2-dimethyloctanoate, glycidyl acrylate, and glycidyl methacrylate are preferred.

When the number of carbon atoms of the alkyl group represented by $R^b$ is 5 or more, the stability of the epoxy compound is ensured, and decomposition prior to reaction with water, a fatty acid, or an oxidatively degraded product, or self-polymerization in which the epoxy compounds polymerize with each other can be suppressed so that the desired functions are easily obtained. On the other hand, when the number of carbon atoms of the alkyl group or alkenyl group represented by $R^b$ is 18 or less, the solubility with a refrigerant is satisfactorily ensured so that it is possible that defects such as poor cooling due to deposition in a refrigerating machine hardly occur.

The alicyclic epoxy compound is a compound having a partial structure represented by the following General Formula (C-3) in which carbon atoms constituting an epoxy group directly constitute an alicyclic ring.

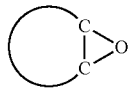

(C-3)

As the alicyclic epoxy compound, for example, 1,2-epoxycyclohexane, 1,2-epoxycyclopentane, 3',4'-epoxycyclohexylmethyl-3,4-epoxycyclohexane carboxylate, bis(3,4-epoxycyclohexylmethyl)adipate, exo-2,3-epoxynorbornane, bis(3,4-epoxy-6-methylcyclohexylmethyl)adipate, 2-(7-oxabicyclo[4.1.0]hept-3-yl)-spiro(1,3-dioxane-5,3'-[7]oxabicyclo[4.1.0]heptane, 4-(1'-methylepoxyethyl)-1,2-epoxy-2-methylcyclohexane, 4-epoxyethyl-1,2-epoxycyclohexane are preferred.

Examples of an allyloxirane compound include 1,2-epoxystyrene and alkyl-1,2-epoxystyrene.

Examples of the alkyloxirane compound include 1,2-epoxybutane, 1,2-epoxypentane, 1,2-epoxyhexane, 1,2-epoxyheptane, 1,2-epoxyoctane, 1,2-epoxynonane, 1,2-epoxydecane, 1,2-epoxyundecane, 1,2-epoxydodecane, 1,2-epoxytridecane, 1,2-epoxytetradecane, 1,2-epoxypentadecane, 1,2-epoxyhexadecane, 1,2-epoxyheptadecane, 1,1,2-epoxyoctadecane, 2-epoxynonadecane, and 1,2-epoxyicosane.

Examples of the epoxidized fatty acid monoester include an ester of an epoxidized fatty acid having 12 to 20 carbon atoms with alcohol, or phenol or alkyl phenol having 1 to 8 carbon atoms. As the epoxidized fatty acid monoester, butyl-, hexyl-, benzyl-, cyclohexyl-, methoxyethyl-, octyl-, phenyl- and butylphenyl-esters of epoxystearic acid are preferably used.

Examples of the epoxidized vegetable oil include an epoxy compound of a vegetable oil, such as a soybean oil, a linseed oil, and a cottonseed oil.

The epoxy compound is preferably at least one selected from a glycidyl ester-type epoxy compound and a glycidyl ether-type epoxy compound, and from the viewpoint of excellent suitability with a resin material (for example, nylon) to be used in a member in a refrigerating machine, the epoxy compound is preferably at least one selected from glycidyl ester-type epoxy compounds.

The content of the epoxy compound is preferably 0.1 to 4% by mass, more preferably 0.2 to 2% by mass, further preferably 0.4 to 1.5% by mass, and particularly preferably 0.4 to 1.2% by mass based on the total amount of the refrigerating machine oil.

In a case where the refrigerating machine oil contains a glycidyl ester-type epoxy compound as the epoxy compound, the content of the glycidyl ester-type epoxy compound is preferably 0.01 to 2% by mass, more preferably 0.1 to 2% by mass, further preferably 0.2 to 1.5% by mass, even further preferably 0.4 to 1.2% by mass, and particularly preferably 0.5 to 0.9% by mass based on the total amount of the refrigerating machine oil.

In a case where the refrigerating machine oil contains a glycidyl ether-type epoxy compound as the epoxy compound, the content of the glycidyl ether-type epoxy compound is preferably 0.01 to 2% by mass, more preferably 0.1 to 2% by mass, further preferably 0.2 to 1.5% by mass, even further preferably 0.4 to 1.2% by mass, and particularly preferably 0.5 to 0.9% by mass based on the total amount of the refrigerating machine oil.

The mass ratio of the content of the epoxy compound to the content of the dialkyl hydrogen phosphite in the refrigerating machine oil (the content of the epoxy compound/the content of the dialkyl hydrogen phosphite) is preferably 0.1 or more, more preferably 0.5 or more, and further preferably 1 or more, and is preferably 30 or less, more preferably 10 or less, and further preferably 5 or less.

The refrigerating machine oil may further contain an antioxidant. The antioxidant may be, for example, a phenolic antioxidant such as di-tert-butyl-p-cresol. The content of the antioxidant may be, for example, 0.01% by mass or more and 5% by mass or less based on the total amount of the refrigerating machine oil.

The refrigerating machine oil may further contain a phosphorus-based antiwear agent other than the dialkyl hydrogen phosphite in the present embodiment. Such a phosphorus-based antiwear agent may be, for example, a hydrogen phosphite other than the dialkyl hydrogen phosphite in the present embodiment; a phosphoric acid ester such as triphenyl phosphate (TPP) or tricresyl phosphate (TCP); a thiophosphoric acid ester such as triphenyl phosphorothionate (TPPT); or the like. The content of the phosphorus-based antiwear agent other than the dialkyl hydrogen phosphite may be, for example, 0.01% by mass or more and 5% by mass or less based on the total amount of the refrigerating machine oil.

The refrigerating machine oil may further contain other additives in addition to the aforementioned components. Examples of the other additives include an acid scavenger other than the epoxy compound, an extreme pressure agent, an oiliness agent, a defoaming agent, a metal deactivator, an antiwear agent other than the phosphorus-based antiwear agent, a viscosity index improver, a pour point depressant, and a detergent-dispersant. The content of these additives may be preferably 10% by mass or less and more preferably 5% by mass or less based on the total amount of the refrigerating machine oil.

From the viewpoint of more effectively improving antiwear property, it is preferable that the refrigerating machine oil does not substantially contain an amine-based compound. Herein, the expression "does not substantially contain an amine-based compound" indicates that the content of the amine-based compound is less than 0.5% by mass based on the total amount of the refrigerating machine oil, but the content thereof is more preferably less than 0.1% by mass, further preferably less than 0.01% by mass, and particularly preferably less than 0.001% by mass.

The kinematic viscosity at 40° C. of the refrigerating machine oil may be preferably 3 $mm^2/s$ or more, more preferably 4 $mm^2/s$ or more, and further preferably 5 $mm^2/s$ or more. The kinematic viscosity at 40° C. of the refrigerating machine oil may be preferably 500 $mm^2/s$ or less, more preferably 400 $mm^2/s$ or less, and further preferably 300 $mm^2/s$ or less. The kinematic viscosity at 100° C. of the refrigerating machine oil may be preferably 1 $mm^2/s$ or more and more preferably 2 $mm^2/s$ or more. The kinematic viscosity at 100° C. of the refrigerating machine oil may be preferably 100 $mm^2/s$ or less and more preferably 50 $mm^2/s$ or less. The kinematic viscosity in the present invention means a kinematic viscosity measured according to JIS K2283:2000.

The pour point of the refrigerating machine oil may be preferably −10° C. or lower and more preferably −20° C. or lower. The pour point in the present invention means a pour point measured according to JIS K2269:1987.

The volume resistivity of the refrigerating machine oil may be preferably $1.0\times10^9$ Ω·m or more, more preferably $1.0\times10^{10}$ Ω·m or more, and further preferably $1.0\times10^{11}$ Ω·m or more. The volume resistivity in the present invention means a volume resistivity at 25° C. measured according to JIS C2101:1999.

The moisture content of the refrigerating machine oil may be preferably 200 ppm or less, more preferably 100 ppm or less, and further preferably 50 ppm or less based on the total amount of the refrigerating machine oil.

The acid value of the refrigerating machine oil may be preferably 1.0 mg KOH/g or less and more preferably 0.1 mg KOH/g or less. The acid value in the present invention means an acid value measured according to JIS K2501: 2003.

The ash content of the refrigerating machine oil may be preferably 100 ppm or less and more preferably 50 ppm or less. The ash content in the present invention means an ash content measured according to JIS K2272:1998.

The refrigerating machine oil according to the present embodiment usually exists as a working fluid composition for a refrigerating machine mixed with a refrigerant in a refrigerating machine. That is, the refrigerating machine oil according to the present embodiment is used with a refrigerant, and the working fluid composition for a refrigerating machine according to the present embodiment contains the refrigerating machine oil according to the present embodiment and a refrigerant.

Examples of such a refrigerant include a saturated hydrofluorocarbon refrigerant, an unsaturated hydrofluorocarbon refrigerant, a hydrocarbon refrigerant, a fluorine-containing ether-based refrigerant such as perfluoroethers, a bis(trifluoro methyl)sulfide refrigerant, a trifluoride iodide methane refrigerant, a natural refrigerant such as ammonia and carbon dioxide, and a mixed refrigerant of two or more kinds selected from these refrigerants.

Examples of the saturated hydrofluorocarbon refrigerant include a saturated hydrofluorocarbon having preferably 1 to 3 carbon atoms and more preferably 1 to 2 carbon atoms. Specifically, examples thereof include difluoromethane (R32), trifluoromethane (R23), pentafluoroethane (R125), 1,1,2,2-tetrafluoroethane (R134), 1,1,1,2-tetrafluoroethane (R134a), 1,1,1-trifluoroethane (R143a), 1,1-difluoroethane (R152a), fluoroethane (R161), 1,1,1,2,3,3,3-heptafluoropropane (R227ea), 1,1,1,2,3,3-hexafluoropropane (R236ea), 1,1,1,3,3,3-hexafluoropropane (R236fa), 1,1,1,3,3-pentafluoropropane (R245fa), 1,1,1,3,3-pentafluorobutane (R365mfc), and mixtures of two or more kinds thereof.

The saturated hydrofluorocarbon refrigerant is appropriately selected from the above examples depending on applications and required performance and preferred examples thereof include R32 alone; R23 alone; R134a alone; R125 alone; a mixture of R134a/R32=60 to 80% by mass/40 to 20% by mass; a mixture of R32/R125=40 to 70% by mass/60 to 30% by mass; a mixture of R125/R143a=40 to 60% by mass/60 to 40% by mass; a mixture of R134a/R32/R125=60% by mass/30% by mass/10% by mass; a mixture of R134a/R32/R125=40 to 70% by mass/15 to 35% by mass/5 to 40% by mass; and a mixture of R125/R134a/R143a=35 to 55% by mass/1 to 15% by mass/40 to 60% by mass. More specifically, a mixture of R134a/R32=70/30% by mass; a mixture of R32/R125=60/40% by mass; a mixture of R32/R125=50/50% by mass (R410A); a mixture of R32/R125=45/55% by mass (R410B); a mixture of R125/R143a=50/50% by mass (R507C); a mixture of R32/R125/

R134a=30/10/60% by mass; a mixture of R32/R125/R134a=23/25/52% by mass (R407C); a mixture of R32/R125/R134a=25/15/60% by mass (R407E); a mixture of R125/R134a/R143a=44/4/52% by mass (R404A), and the like can be used.

The unsaturated hydrofluorocarbon (HFO) refrigerant is preferably fluoropropene and more preferably fluoropropene having 3 to 5 fluorine atoms. The unsaturated hydrofluorocarbon refrigerant is specifically preferably any one or a mixture of two or more selected from 1,2,3,3,3-pentafluoropropene (HFO-1225ye), 1,3,3,3-tetrafluoropropene (HFO-1234ze), 2,3,3,3-tetrafluoropropene (HFO-1234yf), 1,2,3,3-tetrafluoropropene (HFO-1234ye), and 3,3,3-trifluoropropene (HFO-1243zf). From the viewpoint of physical properties of a refrigerant, one or two or more selected from HFO-1225ye, HFO-1234ze, and HFO-1234yf are preferred.

The hydrocarbon refrigerant is preferably a hydrocarbon having 1 to 5 carbon atoms and more preferably a hydrocarbon having 2 to 4 carbon atoms. Specific examples of the hydrocarbon include methane, ethylene, ethane, propylene, propane (R290), cyclopropane, normal butane, isobutane, cyclobutane, methylcyclopropane, 2-methylbutane, normal pentane, and mixtures of two or more kinds thereof. Of these, a gaseous hydrocarbon refrigerant is preferably used at 25° C. and 1 atmosphere, and propane, normal butane, isobutane, 2-methylbutane, or a mixture thereof is preferred.

The content of the refrigerating machine oil in the working fluid composition for a refrigerating machine may be preferably 1 to 500 parts by mass and more preferably 2 to 400 parts by mass with respect to 100 parts by mass of the refrigerant.

The refrigerating machine oil and the working fluid composition for a refrigerating machine according to the present embodiment are suitably used for air conditioners having reciprocating or rotary hermetic compressors, refrigerators, open or closed automotive air conditioners, dehumidifiers, water heaters, freezers, refrigerating warehouse, vending machines, showcases, refrigerating machines in chemical plants or the like, refrigerating machines having centrifugal compressors, and the like.

EXAMPLES

Hereinafter, the present invention will be described in more detail based on Examples; however, the present invention is not limited to Examples.

Refrigerating machine oils having compositions shown in Table 1 to Table 3 (% by mass based on the total amount of the refrigerating machine oil) were prepared by using base oils and additives described below.

(Base Oil)

A1: Polyol ester (40° C. kinematic viscosity: 68 $mm^2/s$, 100° C. kinematic viscosity: 8.1 $mm^2/s$) of pentaerythritol and a mixed fatty acid of 2-methylpropanoic acid/3,5,5-trimethylhexanoic acid (mixing ratio (mass ratio): 35/65)

A2: Mixed base oil of (a1) and (a2) described below (mixing ratio (mass ratio): (a1)/(a2)=70/30)

(a1) Polyol ester (40° C. kinematic viscosity: 46 $mm^2/s$, 100° C. kinematic viscosity: 6.3 $mm^2/s$) of pentaerythritol and a mixed fatty acid of 2-methylpropanoic acid/3,5,5-trimethylhexanoic acid (mixing ratio (mass ratio): 60/40)

(a2) Complex ester (kinematic viscosity at 40° C.: 146 $mm^2/s$, viscosity index: 140) obtained by reacting an ester intermediate resulting from a reaction of neopentyl glycol (1 mol) and 1,4-butanediol (0.2 mol) with adipic acid (1.5 mol) further with 3,5,5-trimethylhexanol (1.1 mol), and distilling off a remaining unreacted substance (Dialkyl Hydrogen Phosphite)

B1: Di(2-Ethylhexyl) hydrogen phosphite

B2: Dilauryl hydrogen phosphite (Epoxy Compound)

C1: Glycidyl neodecanoate (Other Additives)

D1: Dioleyl hydrogen phosphite

E1: Mixture of a phenolic antioxidant, a phosphorus-based antiwear agent, or the like The antiwear property of each refrigerating machine oil of Examples 1 and 2 and Comparative Example 1 was evaluated by procedures described below. Results are shown in Table 1.

(Evaluation of Antiwear Property)

The antiwear property was evaluated by a high-speed four-ball test according to ASTM D4172-94. The test was performed by using SUJ2 as a rigid sphere under conditions including a test oil amount of 20 mL, a test temperature of 80° C., a rotation speed of 1200 rpm, an applied load of 294 N, and a test time of 30 minutes, and a wear scar diameter (mm) of a fixed sphere was measured. A smaller wear scar diameter means that antiwear property is excellent.

TABLE 1

| | | Example 1 | Example 2 | Comparative Example 1 |
|---|---|---|---|---|
| Composition (% by mass) | A1 | Remainder | Remainder | Remainder |
| | B1 | 0.5 | — | — |
| | B2 | — | 0.3 | — |
| | C1 | 0.9 | 0.9 | 0.9 |
| | D1 | — | — | 0.3 |
| Antiwear property (mm) | | 0.49 | 0.35 | 0.83 |

The antiwear property of each refrigerating machine oil of Examples 3 to 7 and Comparative Example 2 was evaluated by procedures described below. Results are shown in Table 2 and Table 3.

(Evaluation of Antiwear Property)

A friction tester using a vane (SKH-51) as an upper test piece and a disc (SNCM220 HRC50) as a lower test piece was mounted inside a sealed container. After introducing 600 g of each refrigerating machine oil into the friction test area and the system interior was vacuum deaerated, 100 g of R32 refrigerant was introduced and heated. After adjusting the temperature in the sealed container to 110° C., a wear test was performed at an applied load of 1000 N and a rotation speed of 750 rpm, and the vane wear amount and the disc wear amount after 60 minutes of the test were measured. A smaller wear amount means that antiwear property is excellent.

TABLE 2

| | | Example 3 | Example 4 | Example 5 |
|---|---|---|---|---|
| Composition (% by mass) | A2 | Remainder | Remainder | Remainder |
| | B1 | 0.5 | 0.3 | 0.1 |
| | B2 | — | — | — |
| | C1 | 0.9 | 0.9 | 0.9 |
| | D1 | — | — | — |
| | E1 | 1.8 | 1.8 | 1.8 |
| Vane wear amount (μm) | | 0.8 | 0.8 | 0.7 |
| Disc wear amount (μm) | | 0.27 | 0.32 | 0.25 |

TABLE 3

| | | Example 6 | Example 7 | Comparative Example 2 |
|---|---|---|---|---|
| Composition (% by mass) | A2 | Remainder | Remainder | Remainder |
| | B1 | 0.07 | — | — |
| | B2 | — | 0.1 | — |
| | C1 | 0.9 | 0.9 | 0.9 |
| | D1 | — | — | 0.3 |
| | E1 | 1.8 | 1.8 | 1.8 |
| Vane wear amount (μm) | | 0.8 | 0.8 | 1.2 |
| Disc wear amount (μm) | | 0.07 | 0.30 | 0.58 |

The invention claimed is:

1. A refrigerating machine oil comprising:

a lubricating base oil;

a dialkyl hydrogen phosphite having two alkyl groups having 8 to 12 carbon atoms in the molecule; and an epoxy compound; wherein the lubricating base oil comprises at least one selected from the group consisting of a polyol ester and a complex ester, the dialkyl hydrogen phosphite is at least one selected from the group consisting of a compound represented by the following Formula (b-1) and a compound represented by the following Formula (b-2):

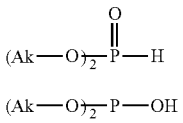

(b-1)

(b-2)

wherein Ak represents an alkyl group having 8 to 12 carbon atoms, the epoxy compound comprises at least one selected from the group consisting of a glycidyl ether-type epoxy compound, a glycidyl ester-type epoxy compound, an oxirane compound, an alkyloxirane compound, an alicyclic epoxy compound, an epoxidized fatty acid monoester, and an epoxidized vegetable oil, and a content of the lubricating base oil is 90% by mass or more, a content of the dialkyl hydrogen phosphite is 0.07% by mass or more and 0.5% by mass or less, and a content of the epoxy compound is 0.1 to 4% by mass, based on the total amount of the refrigerating machine oil.

2. The refrigerating machine oil according to claim 1, further comprising at least one selected from the group consisting of an antioxidant, a phosphorus-based antiwear agent other than the dialkyl hydrogen phosphite, an acid scavenger other than the epoxy compound, an extreme pressure agent, an oiliness agent, a defoaming agent, a metal deactivator, an antiwear agent other than the phosphorus-based antiwear agent, a viscosity index improver, a pour point depressant, and a detergent-dispersant.

3. A working fluid composition for a refrigerating machine comprising:

a refrigerating machine oil; and a refrigerant, wherein the refrigerating machine oil comprises:

a lubricating base oil;

a dialkyl hydrogen phosphite having two alkyl groups having 8 to 12 carbon atoms in the molecule; and an epoxy compound; wherein the lubricating base oil comprises at least one selected from the group consisting of a polyol ester and a complex ester, the dialkyl hydrogen phosphite is at least one selected from the group consisting of a compound represented by the following Formula (b-1) and a compound represented by the following Formula (b-2):

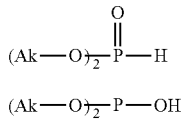

(b-1)

(b-2)

wherein Ak represents an alkyl group having 8 to 12 carbon atoms, the epoxy compound comprises at least one selected from the group consisting of a glycidyl ether-type epoxy compound, a glycidyl ester-type epoxy compound, an oxirane compound, an alkyloxirane compound, an alicyclic epoxy compound, an epoxidized fatty acid monoester, and an epoxidized vegetable oil, and a content of the lubricating base oil is 90% by mass or more, a content of the dialkyl hydrogen phosphite is 0.07% by mass or more and 0.5% by mass or less, and a content of the epoxy compound is 0.1 to 4% by mass, based on the total amount of the refrigerating machine oil.

4. The working fluid composition for a refrigerating machine according to claim 3, wherein the refrigerating machine oil further comprises at least one selected from the group consisting of an antioxidant, a phosphorus-based antiwear agent other than the dialkyl hydrogen phosphite, an acid scavenger other than the epoxy compound, an extreme pressure agent, an oiliness agent, a defoaming agent, a metal deactivator, an antiwear agent other than the phosphorus-based antiwear agent, a viscosity index improver, a pour point depressant, and a detergent-dispersant.

5. The working fluid composition for a refrigerating machine according to claim 3, wherein the refrigerant comprises a saturated hydrofluorocarbon refrigerant.

6. The working fluid composition for a refrigerating machine according to claim 3, wherein the refrigerant comprises difluoromethane.

* * * * *